US009041756B2

(12) United States Patent
Miyadera

(10) Patent No.: US 9,041,756 B2
(45) Date of Patent: May 26, 2015

(54) OPTICAL WRITING CONTROLLER, IMAGE FORMING APPARATUS, AND OPTICAL WRITING CONTROL METHOD

(71) Applicant: Tatsuya Miyadera, Kanagawa (JP)

(72) Inventor: Tatsuya Miyadera, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/338,412

(22) Filed: Jul. 23, 2014

(65) Prior Publication Data

US 2015/0042738 A1 Feb. 12, 2015

(30) Foreign Application Priority Data

Aug. 8, 2013 (JP) ..... 2013-165589

(51) Int. Cl.

| | |
|---|---|
| ***B41J 2/385*** | (2006.01) |
| ***B41J 2/435*** | (2006.01) |
| ***B41J 2/47*** | (2006.01) |
| ***G03G 15/043*** | (2006.01) |
| ***G03G 15/01*** | (2006.01) |

(52) U.S. Cl.

CPC ..... *G03G 15/043* (2013.01); *G03G 15/011* (2013.01)

(58) Field of Classification Search

USPC ..... 347/116, 229, 234, 235, 248–250; 399/49, 66, 72–74, 126, 301

See application file for complete search history.

(56) References Cited

U.S. PATENT DOCUMENTS

| | | | | |
|---|---|---|---|---|
| 6,920,303 | B2 * | 7/2005 | Yamanaka et al. | 399/301 |
| 7,729,024 | B2 * | 6/2010 | Kobayashi et al. | 358/526 |
| 8,107,833 | B2 * | 1/2012 | Yoshida | 399/44 |
| 2008/0038024 | A1 | 2/2008 | Miyadera | |
| 2008/0069602 | A1 | 3/2008 | Miyadera | |
| 2008/0170868 | A1 | 7/2008 | Miyadera | |
| 2008/0212986 | A1 | 9/2008 | Miyadera | |
| 2009/0074476 | A1 | 3/2009 | Miyadera | |
| 2009/0190940 | A1 | 7/2009 | Miyadera | |
| 2009/0196636 | A1 | 8/2009 | Miyadera | |
| 2009/0324263 | A1 | 12/2009 | Shimizu et al. | |
| 2010/0119273 | A1 | 5/2010 | Komai et al. | |
| 2010/0239331 | A1 | 9/2010 | Miyadera et al. | |

(Continued)

FOREIGN PATENT DOCUMENTS

| | | |
|---|---|---|
| JP | 2009-069767 | 4/2009 |
| JP | 2014-109613 | 6/2014 |

OTHER PUBLICATIONS

U.S. Appl. No. 14/134,384, filed Dec. 19, 2013.

*Primary Examiner* — Hai C Pham

(74) *Attorney, Agent, or Firm* — Harness, Dickey & Pierce, P.L.C.

(57) ABSTRACT

An optical writing controller that controls a light source to expose a photoconductor and forms an electrostatic latent image on the photoconductor calculates a correction value for correcting a superimposing position where the developed images for different colors developing each of the electrostatic latent images formed on each of the multiple photoconductors are superimposed based on the detection signal output by a pattern detection sensor that detects a pattern for correcting the superimposing position, controls the multiple light sources to draw a predetermined pattern repeatedly in the sub-scanning direction so that stepwise patterns whose width in the main scanning direction varies with repetition are formed, and determines the width in the main scanning direction of the patterns for correcting based on the strength of the detection signal output by the pattern detection sensor.

9 Claims, 13 Drawing Sheets

(56) References Cited

U.S. PATENT DOCUMENTS

| | | | |
|---|---|---|---|
| 2011/0026082 | A1 | 2/2011 | Miyadera et al. |
| 2011/0052232 | A1 | 3/2011 | Ohshima et al. |
| 2011/0228364 | A1 | 9/2011 | Miyadera et al. |
| 2011/0268461 | A1 | 11/2011 | Shirasaki et al. |
| 2011/0304867 | A1 | 12/2011 | Tokoyama et al. |
| 2012/0057889 | A1 | 3/2012 | Yamaguchi et al. |
| 2012/0061909 | A1 | 3/2012 | Shikama et al. |
| 2012/0062682 | A1 | 3/2012 | Komai et al. |
| 2012/0229866 | A1 | 9/2012 | Miyazaki et al. |
| 2012/0262750 | A1 | 10/2012 | Kinoshita et al. |
| 2012/0287479 | A1 | 11/2012 | Takahashi et al. |
| 2012/0288291 | A1 | 11/2012 | Miyadera |
| 2013/0004194 | A1 | 1/2013 | Shirasaki et al. |
| 2013/0044176 | A1 | 2/2013 | Shirasaki et al. |
| 2013/0063536 | A1 | 3/2013 | Komai et al. |
| 2013/0070040 | A1 | 3/2013 | Miyadera et al. |
| 2013/0071130 | A1 | 3/2013 | Hayashi et al. |
| 2013/0084109 | A1 | 4/2013 | Shikama et al. |
| 2013/0207339 | A1 | 8/2013 | Yokoyama et al. |
| 2013/0242318 | A1 | 9/2013 | Yamaguchi et al. |
| 2013/0343775 | A1 | 12/2013 | Yamaguchi et al. |
| 2014/0002564 | A1 | 1/2014 | Miyadera et al. |
| 2014/0028773 | A1 | 1/2014 | Miyadera |
| 2014/0049591 | A1 | 2/2014 | Shirasaki et al. |
| 2014/0078521 | A1 | 3/2014 | Hayashi et al. |
| 2014/0125752 | A1 | 5/2014 | Miyadera |
| 2014/0139607 | A1 | 5/2014 | Hayashi et al. |
| 2014/0146120 | A1 | 5/2014 | Miyadera |
| 2014/0146371 | A1 | 5/2014 | Hayashi et al. |
| 2014/0152754 | A1 | 6/2014 | Murakami et al. |
| 2014/0153010 | A1 | 6/2014 | Miyadera et al. |
| 2014/0153042 | A1 | 6/2014 | Kawanabe et al. |
| 2014/0153943 | A1 | 6/2014 | Miyadera et al. |

* cited by examiner

FIG. 15

| TIMING | CRITERION | REASON TO PERFORM |
|---|---|---|
| WHEN ASSEMBLY STATE IS CHANGED | DETECT THAT PHOTO CONDUCTOR UNIT IS REPLACED | BECAUSE ASSEMBLY STATE OF MAIN UNIT IS CHANGED AND PERFORMANCE OF PATTERN DETECTION SENSOR COULD BE AFFECTED |
| | DETECT THAT INTERMEDIATE TRANSFER UNIT IS REPLACED | |
| | DETECT THAT ENVIRONMENT CHANGES | |
| WHEN MALFUNCTION OCCURS | IN CASE OF FAILING TO ADJUST LIGHT AMOUNT IN SENSOR DEVICE | BECAUSE PERFORMANCE OF PATTERN DETECTION SENSOR DOES NOT WORK PROPERLY AND PATTERN WIDTH COULD NOT BE OPTIMIZED |
| | IN CASE OF FAILING TO CORRECT DISPLACEMENT | |
| | IN CASE OF FAILING TO CORRECT DENSITY | |
| ON REGULAR BASIS | PRINT PREDETERMINED PAGE | BECAUSE ASSEMBLY STATE OF MAIN UNIT IS CHANGED DUE TO AGING AND PERFORMANCE OF PATTERN DETECTION SENSOR COULD BE AFFECTED |
| | AFTER PREDETERMINED PERIOD OF TIME | |

OPTICAL WRITING CONTROLLER, IMAGE FORMING APPARATUS, AND OPTICAL WRITING CONTROL METHOD

CROSS-REFERENCE TO RELATED APPLICATION

This patent application is based on and claims priority pursuant to 35 U.S.C. §119 to Japanese Patent Application No. 2013-165589, filed on Aug. 8, 2013 in the Japan Patent Office, the entire disclosure of which is hereby incorporated by reference herein.

BACKGROUND

1. Technical Field

The present invention relates to an optical writing controller, an image forming apparatus, and an optical writing control method.

2. Background Art

With increasing digitization of information, image processing apparatuses such as printers and facsimiles for outputting digitized information and scanners for digitizing documents have become indispensable. Usually, such image processing apparatuses are configured as multifunctional peripherals (MFPs) that can be used as a printer, a facsimile, a scanner, and a copier including capabilities such as an image pickup capability, an image forming capability, and a communication capability.

Among such image processing apparatuses, electrophotographic image forming apparatuses are generally used for outputting digitized documents. In electrophotographic image forming apparatuses, an electrostatic latent image is formed by exposing a photoconductor, a toner image is formed by developing the electrostatic latent image with a developer such as toner, and a paper printout is output after transferring the toner image onto the paper.

In the electrophotographic image forming apparatuses described above, by matching timing of drawing the electrostatic latent image by exposing the photoconductor to timing of conveying the paper, the image is formed in the correct area on the paper. In tandem-type image forming apparatuses that form color images using multiple photoconductors, timing of exposure of the photoconductors for each color undergoes adjustment processes so that the images developed on the photoconductors for each color are superimposed precisely on each other at the same location. Hereinafter, these adjusting processes are referred to as "alignment correction".

There are two ways to perforin alignment correction. One is a mechanical adjustment method that physically adjusts the relative positions of the photoconductor and the light source that exposes the photoconductor. The second method is an image processing method that ultimately forms the image at a particular position by adjusting the image to be output in accordance with the extent of image displacement. In the image processing method, by drawing a pattern for correcting and scanning the pattern, the image forming apparatus can obtain design timing, and actual timing that the pattern is actually read. The image forming apparatus performs correction based on the difference between design timing and actual timing so as to form the image on the desired position.

SUMMARY

The present invention provides a novel optical writing unit, an image forming apparatus, and an optical writing control method that can adjust the size of the pattern for correcting the position where the image is drawn in the image forming apparatus to correspond to the fluctuation of the detection area of the sensor that detects the pattern for correcting.

More specifically, an embodiment of the present invention provides an optical writing controller that controls a light source to expose a photoconductor and forms an electrostatic latent image on the photoconductor calculates a correction value for correcting a superimposing position where the developed images for different colors developing each of the electrostatic latent images formed on each of the multiple photoconductors are superimposed based on the detection signal output by the sensor that detects a pattern for correcting the superimposing position, controls the multiple light sources to draw a predetermined pattern repeatedly in the sub-scanning direction so that stepwise patterns whose width in the main scanning direction varies with repetition are formed, and determines the width in the main scanning direction of the patterns for correcting based on strength of the detection signal output by the sensor that detects the stepwise patterns.

Another embodiment of the present invention provides an image forming apparatus that includes the optical writing controller described above.

BRIEF DESCRIPTION OF THE DRAWINGS

A more complete appreciation of the disclosure and many of the attendant advantages thereof will be readily obtained as the same becomes better understood by reference to the following detailed description when considered in conjunction with the accompanying drawings.

FIG. 15 is a table illustrating information for determining whether or not it is necessary to perform the configuration of the pattern width as an embodiment of the present invention.

DETAILED DESCRIPTION

Figure 1:
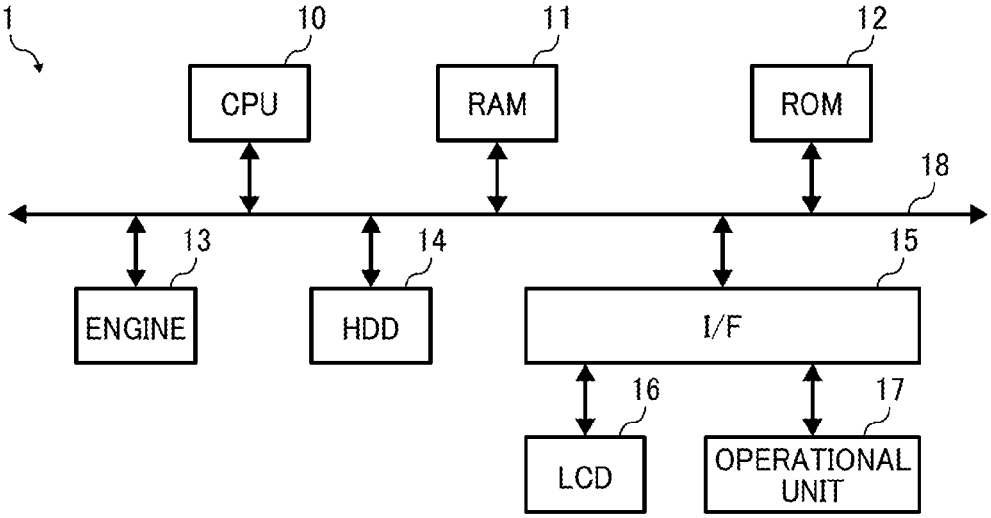
FIG. 1 is a block diagram illustrating a hardware configuration of an image forming apparatus as an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In order to improve the accuracy in reading a pattern for correcting, the pattern may be drawn with a size corresponding to the area scanned by a scanning sensor. In drawing the pattern for correcting whose size is in accordance with the scanning area by the scanning sensor (hereinafter referred to as "detection area"), the size of drawn pattern becomes small simply, and that can also reduce the toner consumption.

Here, in case of adjusting the size of the pattern to the detection area, the size of drawn pattern is determined by the size of the detection area. However, the detection area can fluctuate due to a mounting error of the scanning sensor. As a result, the necessary size of the drawn pattern can fluctuate.

If the size of the pattern is smaller than the detection area, it is possible that detection accuracy of the pattern degrades. By contrast, if the size of the pattern is larger than the detection area, the toner consumption becomes large, and that suppresses the effect of reducing the toner consumption described above.

In the following embodiments, an image forming apparatus in which the size of the pattern for correcting the position where the image is drawn corresponds to the fluctuation of the detection area of the sensor that detects the pattern for correcting is provided.

Embodiments of the present invention will be described in detail below with reference to the drawings. In the embodiments of the present invention, a MFP is taken as an example of an image forming apparatus. The image forming apparatus in the embodiments of the present invention adopts electrophotographic technology, and a main issue of the present invention is to configure a size of a pattern drawn in alignment correction to correct timing of exposing a photoconductor.

FIG. 1 is a block diagram illustrating a hardware configuration of an image forming apparatus as an embodiment. As shown in FIG. 1, an image forming apparatus 1 in this embodiment includes an engine to execute forming images in addition to the same configuration as an information processing terminal such as a standard server and a personal computer (PC). That is, in the image forming apparatus 1, a Central Processing Unit (CPU) 10, a Random Access Memory (RAM) 11, a Read Only Memory (ROM) 12, an engine 13, a Hard Disk Drive (HDD) 14, and an I/F 15 are connected with each other via a bus 18. In addition, a Liquid Crystal Display (LCD) 16 and an operating device 17 are connected to the I/F 15.

The CPU 10 controls the whole operation of the image forming apparatus 1. The RAM 11 is a volatile storage device that information can be written to and read at high speed, and used as a working area when the CPU 10 processes information. The ROM 12 is a read-only nonvolatile storage device and stores programs such as firmware. The engine 13 executes forming an image in the image forming apparatus 1.

The HDD 14 is a nonvolatile storage device that information can be written to and read and stores an Operating System (OS), various control programs, and application programs etc. The I/F 15 connects the bus 18 to various hardware and networks and controls them. The LCD 16 is a visual interface to check the status of the image forming apparatus 1. The operating device 17 is a user interface such as a keyboard and a mouse to input information into the image forming apparatus 1.

In the hardware configuration described above, programs stored in the ROM 12, the HDD 14, and storage devices such as optical disks (not shown in figures) are read and loaded into the RAM 11, and software control units are configured by the CPU 10's executing calculation in accordance with those programs. Functional blocks to implement functions of the image forming apparatus 1 in this embodiment are configured in combination with the software control units described above and the hardware.

Figure 2:
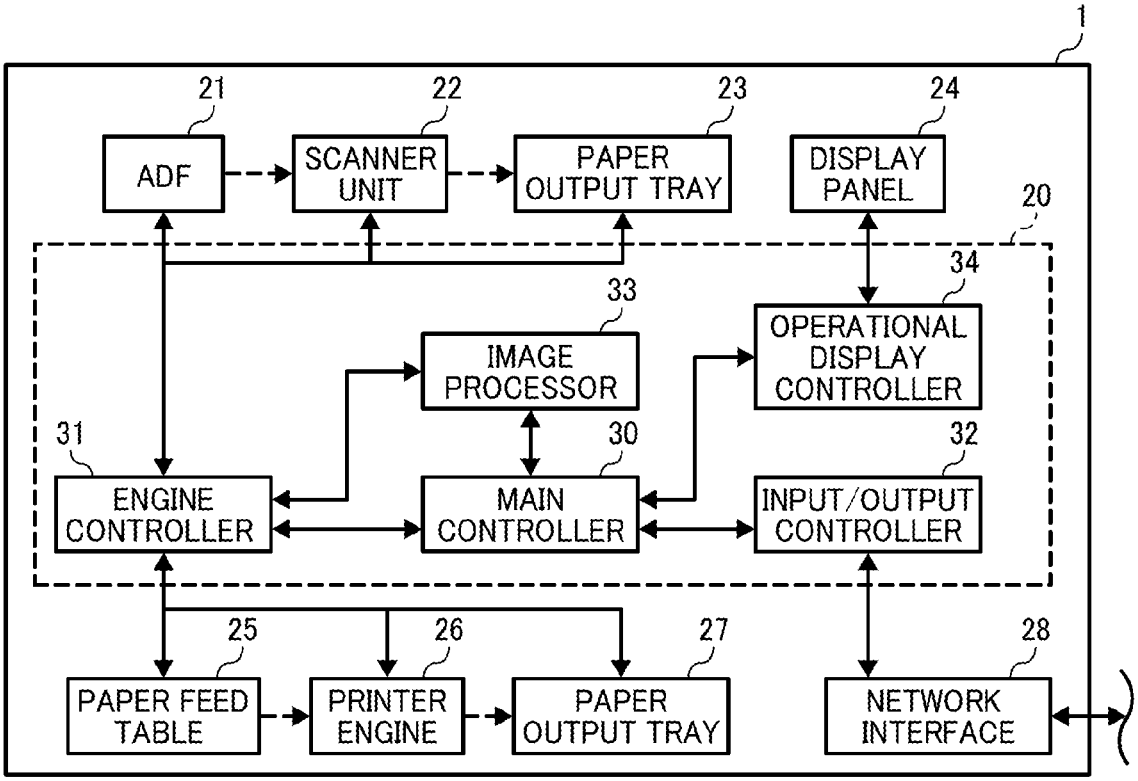
FIG. 2 is a diagram illustrating a functional configuration of the image forming apparatus as an embodiment of the present invention.

Next, a functional configuration of the image forming apparatus 1 in this embodiment will be described below with reference to FIG. 2. FIG. 2 is a diagram illustrating the functional configuration of the image forming apparatus 1 in this embodiment. As shown in FIG. 2, the image forming apparatus 1 in this embodiment includes a controller 20, an Auto Document Feeder (ADF) 110, a scanner unit 22, a paper output tray 23, a display panel 24, a paper feed table 25, a printer engine 26, a paper output tray 27, and a network I/F 28.

In addition, the controller 20 includes a main controller 30, an engine controller 31, an input/output controller 32, an image processor 33, and an operation display controller 34. As shown in FIG. 2, the image forming apparatus 1 is configured as a MFP that includes the scanner unit 22 and the printer engine 26. It should be noted that solid arrows show electrical connections, and dotted arrows show the flow of paper.

The display panel 24 is an output interface to display the status of the image forming apparatus 1 visually and an input interface (operating device) to operate the image forming apparatus 1 directly and input information to the image forming apparatus 1 as a touch panel. The network I/F 28 is an interface for the image forming apparatus 1 to communicate with other apparatuses via the network, and Ethernet and USB I/F are adopted as the network I/F 28.

The controller 20 is configured comprising software and hardware. More particularly, control programs such as firmware stored in the nonvolatile storage device such as the ROM 12, the HDD 14, and the optical disks etc. are loaded into the volatile memory (hereinafter referred to as "memory") such as the RAM 11, and the controller 20 is configured with software control units implemented by operation of the CPU 10 in accordance with the programs and hardware such as integrated circuits. The controller 20 functions as a control unit that controls the whole image forming apparatus 1.

The main controller 30 controls and commands each unit included in the controller 20. The engine controller 31 controls and drives the printer engine 26 and the scanner unit 22 etc. The input/output controller 32 inputs signals and commands input via the network I/F 28 into the main controller 30. In addition, the main controller 30 controls the input/output controller 32 and accesses other apparatuses via the network I/F 28.

The image processor 33 generates drawing data based on print data included in an input print job under the control of the main controller 30. The drawing data is information for the printer engine to draw an image to be formed in the image forming operation. In addition, the print data included in the print job is image data converted into a format that the image forming apparatus 1 can recognize by a printer driver installed in an information processing apparatus such as a PC. The operation display controller 34 displays information on the display panel 24 and notifies the main controller 30 of information input via the display panel 24.

In case the image forming apparatus 1 operates as a printer, first, the input/output controller 32 receives a print job via the network I/F 28. The input/output controller 32 transfers the received print job to the main controller 30. After receiving the print job, the main controller 30 controls the image processor 33 and has the image processor 33 generate drawing data based on print data included in the print job.

After the image processor 33 generates the drawing data, the engine controller 31 controls the printer engine 26 based on the generated drawing data and executes forming an image on paper conveyed from the paper feed table 25. That is, the printer engine 26 functions as an image forming unit. After the printer engine forms the image on the paper, a document is ejected on the paper output tray 27.

In case the image forming apparatus 1 operates as a scanner, the operation display controller 34 or the input/output controller 32 transfers a signal to execute scanning to the main controller 30 in accordance with a request to execute scanning input by a user operation on the display panel 24 or input from an external PC etc. via the network I/F 28. The main controller 30 controls the engine controller 31 based on the received signal to execute scanning.

The engine controller 31 drives the ADF 21 and carries a document to be scanned set on the ADF 21 to the scanner unit 22. In addition, the engine controller 31 drives the scanner unit 22 and scans the document conveyed from the ADF 21. In addition, if the document is set on the scanner unit 22 directly instead of being set on the ADF 21, the scanner unit 22 scans the set document under the control of the engine controller 31. That is, the scanner unit 22 functions as an image pickup unit.

In the scanning operation, an image pick up device such as a CCD included in the scanner unit 22 scans the document optically, and scanned data is generated based on the optical information. The engine controller 31 transfers the scanned data generated by the scanner unit 22 to the image processor 33. The image processor 33 generates image data based on the scanned data received from the engine controller 31 under the control of the main controller 30. The image data generated by the image processor 33 is stored in the storage device such as the HDD 40, etc., included in the image forming apparatus 1. That is, the scanner unit 22, the engine controller 31, and the image processor 33 cooperate and function as a document scanning unit.

The image data that the image processor 33 generates is either stored in the HDD 14 etc. as is or transferred to an external apparatus via the input/output controller 32 and the network I/F 28 in accordance with user operation. That is, the ADF 21 and the engine controller 31 function as an image input unit.

In addition, in case the image forming apparatus 1 functions as a copier, the image processor 33 generates drawing data based on the scanned data that the engine controller 31 received from the scanner unit 22 or the image data that the image processor 33 generated. Just like the printer operation, the engine controller 31 drives the printer engine 26 based on the drawing data.

Figure 3:
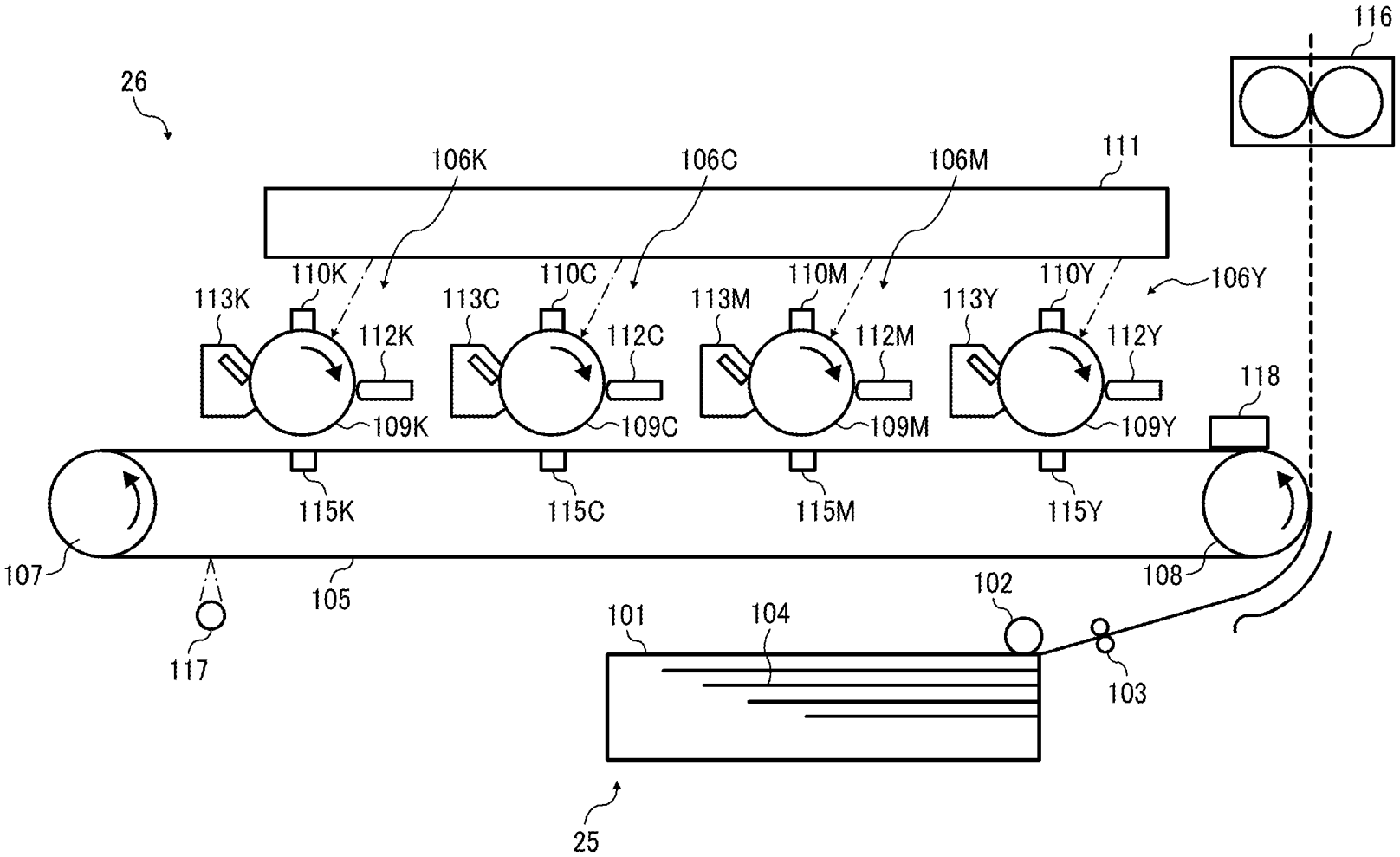
FIG. 3 is a diagram illustrating a configuration of a print engine as an embodiment of the present invention.

Next, a configuration of the printer engine 26 in this embodiment will be described below with reference to FIG. 3. As shown in FIG. 3, in the printer engine 26 of this embodiment, image forming units 106 for each color are laid out along with a conveyance belt 105 as an endless transferring unit, and that configuration is so-called tandem type. That is, multiple image forming units 106Y, 106M, 106 C, and 106K (electrophotographic processing units, hereinafter referred to as the image forming unit 106 collectively) are laid out from upstream of the moving direction of the conveyance belt 105 along with the conveyance belt 105 as an intermediate transfer belt on which an intermediate transfer image to be transferred on paper 104 (an example of a recording medium) fed separately from a paper feed tray 101 by a feeding roller 102 is formed.

The paper is stopped by a resist roller 103 temporarily and then sent to a position where the image is transferred from the conveyance belt 105 in accordance with the timing of forming the image in the image forming unit 106.

These multiple image forming units 106Y, 106M, 106C, and 106K have the same inner configuration except the color of the formed toner image. The image forming unit 106Y forms a black image, the image forming unit 106M forms a magenta image, the image forming unit 106C forms a cyan image, and the image forming unit 106K forms a yellow image. While an operation of the image forming unit 106Y will be described below specifically, it should be noted that cases for other image forming units 106M, 106C, and 106K are the same as the case for the image forming unit 106Y, so symbols distinguished by M, C, and K are assigned to each component in the image forming unit 106M, 106C, and 106K in place of Y assigned to each corresponding component of the image forming unit 106Y in FIG. 3, and their detailed descriptions are omitted.

The conveyance belt 105 is an endless moving belt that runs between a driving roller 107 and a driven roller 108. A driving motor (not shown in figures) drives the driving roller 107. The conveyance belt 105 is moved endlessly by the driving motor, the driving roller 107, and the driven roller 108.

In forming an image, the image forming unit 106Y transfers a yellow toner image firstly on the driven conveyance belt 105. The image forming unit 106Y includes a photoconductor drum 109Y, a charging unit 110Y laid out surrounding of the photoconductor drum 109Y, an optical writing unit 200, a developing unit 112Y, a photoconductor cleaner (not shown in figures), and a neutralizing unit 113Y etc. The optical writing unit 200 is configured to illuminate on each photoconductor drum 109Y, 109M, 109C, and 109K (hereinafter referred to as photoconductor drum 109 collectively) laid out surrounding of the photoconductor drum 109K.

In forming an image, after the charging unit 110Y charges the outer surface of the photoconductor drum 109Y uniformly in the dark, light emitted from the light source corresponding to yellow image in the optical writing unit 200 executes drawing on the outer surface of the photoconductor drum 109Y, and c is formed. The developing unit 112Y visualizes the electrostatic latent image using the yellow toner, and the yellow toner image is formed on the photoconductor drum 109Y.

This toner image is transferred on the conveyance belt 105 by the transferring unit 115Y at the position where the photoconductor drum 109Y contacts the conveyance belt 105 or the photoconductor drum 109Y gets close to the conveyance belt 105 most (the transferring position). This transfer forms an image by yellow toner on the conveyance belt 105. After transferring the toner image, a photoconductor cleaner removes remaining waste toner on the outer surface of the photoconductor drum 109Y. Subsequently, the photoconductor drum 109Y is neutralized by the neutralizing unit 113Y and waits for forming a subsequent image.

As described above, the yellow toner image transferred to the surface of the conveyance belt 105 by the image forming unit 106Y is carried to the subsequent image forming unit 106M by the roller that moves the conveyance belt 105. In the image forming unit 106M, a magenta toner image is foamed on the photoconductor drum 109M by the same image forming process as in the image forming unit 106Y, and the magenta toner image is superimposed on the yellow toner image formed previously and transferred.

The yellow toner image and the magenta toner image transferred to the surface of the conveyance belt 105 are carried to subsequent image forming units 106C and 106K, and a cyan toner image formed on the photoconductor drum 109C and a black toner image formed on the photoconductor drum 109K are superimposed on the existing toner images respectively and transferred in the same way. Consequently, a full-color intermediate transfer image is formed on the conveyance belt 105.

The uppermost paper 104 stored in the paper feed tray 101 is fed sequentially, one sheet at a time, and the intermediate transfer image formed on the conveyance belt 105 is transferred to the surface of the paper at the position where the paper carrying path contacts the conveyance belt 105 or the paper carrying path comes closest to the conveyance belt 105. Consequently, an image is formed on the surface of the paper 104. After forming the image on the surface of the paper 104, the paper 104 is further conveyed to the fixing unit 116, which fixes the image on the surface of the paper 104, and the paper 104 is then ejected to the outside of the image forming apparatus 1.

In the image forming apparatus 1 described above, toner images are not superimposed correctly on a position where those toner images are supposed to be superimposed due to error in distance between axes of the photoconductor drums 109Y, 109M, 109C, and 109K, error in parallelism between the photoconductor drums 109Y, 109M, 109C, and 109K, error in positioning the LEDA 130 inside the optical writing unit 111, and error in timing of writing the electrostatic latent image on the photoconductor drums 109Y, 109M, 109C, and 109K etc., and that results in displacement between colors in some cases.

In addition, due to similar reasons, an image is transferred to an area on the paper that the image is to be transferred outside the area where the image should be transferred under ordinary circumstances. Skew and registration displacement in the sub-scanning direction etc. are mainly known as components for the displacement as well as temperature variation inside the apparatus and expansion/contraction of the conveyance belt due to deterioration over time.

A pattern detection sensor 117 is included in the image forming apparatus 1 to correct the displacement described above. The pattern detection sensor 117 is an optical sensor that scans a pattern for alignment correction and a pattern for correcting density transferred on the conveyance belt 105 by the photoconductor drums 109Y, 109M, 109C, and 109K, and the pattern detection sensor 117 includes a light emitting device that illuminates the pattern drawn on the surface of the conveyance belt 105 with light and a photo acceptance device that receives the reflected light from the pattern for correcting. As shown in FIG. 3, the pattern detection sensor 117 is mounted on the same board along with the direction perpendicular to the conveying direction of the conveyance belt 105 downstream from the photoconductor drums 109Y, 109M, 109C, and 109K.

In the image forming apparatus 1, it is possible that density of an image transferred on the paper 104 varies due to change of the status of the photoconductor drums 109Y, 109M, 109C, and 109K and change of the status of the optical writing unit 111. In order to correct the density variation, density correction is performed by detecting the pattern for correcting density formed in accordance with a predetermined rule and correcting driving parameters for the photoconductor drums 109Y, 109M, 109C, and 109K and driving parameters for optical writing unit 111 based on the detection result.

In addition to the displacement correction by detecting the pattern for alignment correction described above, the pattern detection sensor 117 is used for detecting the pattern for correcting density. The pattern detection sensor 117, the displacement correction, and the density correction will be described in detail later. The printer engine 26 includes the configuration to implement the information processing function such as the CPU 10 shown in FIG. 1, and the configuration is used for controlling the processes described above.

A belt cleaner 118 is included in the image forming apparatus 1 to remove toner of the pattern for correcting drawn on the conveyance belt 105 in the drawing parameter correction described above so that the paper that the conveyance belt 105 conveys does not get dirty. As shown in FIG. 3, the belt cleaner 118 is a cleaning blade pressed on the conveyance belt 105 mounted downstream from the driving roller 107 and upstream from the photoconductor drum 109. The belt cleaner 118 functions as a developer removing unit that removes toner attached to the surface of the conveyance belt 105.

Next, the optical writing unit 111 in this embodiment will be described below.

Figure 4:
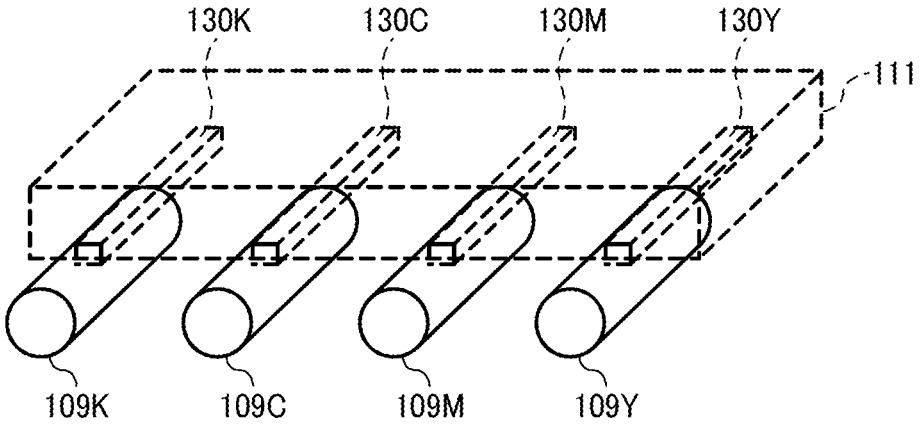
FIG. 4 is a diagram illustrating a configuration of an optical writing unit as an embodiment of the present invention.

FIG. 4 is a diagram illustrating relative positions of the optical writing unit 111 and the photoconductor drum 109 in this embodiment. As shown in FIG. 4, Light-emitting Diode Arrays (LEDA) 130Y, 130M, 130C, and 130K (hereinafter collectively referred to as "LEDA 130") as light sources illuminate a respective one of the photoconductor drum 109Y, 109M, 109C, and 109K.

The LEDA 130 is configured in the way that Light-emitting Diodes (LEDs) as illuminating devices are laid side-by-side in the main scanning direction of the photoconductor drum 109. A controller included in the optical writing unit 111 controls turning on and off each LED laid side-by-side in the main scanning direction for each main scanning line based on the drawing data input from the controller 20, exposes the surface of the photoconductor drum 109 selectively, and forms the electrostatic latent image.

Figure 5:
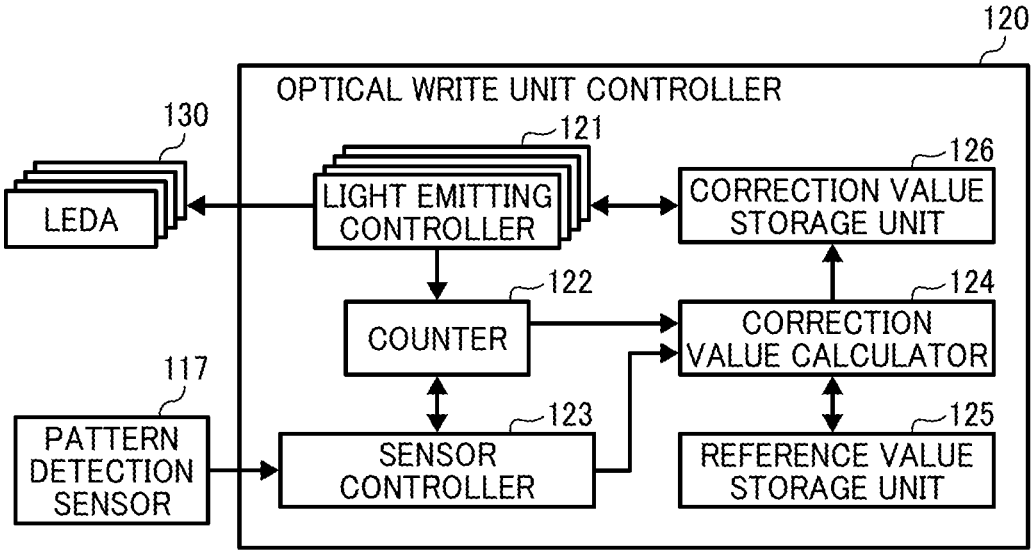
FIG. 5 is a block diagram illustrating a configuration of an optical writing controller and a (Light-emitting Diode Array) LEDA as an embodiment of the present invention.

FIG. 5 is a diagram illustrating a functional configuration of the optical writing unit controller 120 that controls the optical writing unit 111 and connecting relationship with the LEDA 130 and the pattern detection sensor 117 in this embodiment.

As shown in FIG. 5, the optical writing unit controller 120 in this embodiment includes a light emitting controller 121, a counter 122, a sensor controller 123, a correction value calculator 124, a reference value storage unit 125, and a correction value storage unit 126. The optical writing unit controller 120 functions as an optical writing controller that controls the LEDA 130 as the light source.

Also, the optical writing unit 111 in this embodiment includes information processing units such as the CPU 10, the RAM 11, the ROM 12, and the HDD 14, etc., shown in FIG. 1. The optical writing unit controller 120 shown in FIG. 5 is configured by loading control programs stored in the ROM 12 or the HDD 14 into the RAM 11 and operating by the CPU 10 in accordance with the programs just like as the controller 20 in the image forming apparatus 1.

The light emitting controller 121 is a light source controller that controls the LEDA 130 based on image information input from the engine controller 31 in the controller 20. That is, the light emitting controller 121 also functions as a pixel information acquisition unit. The light emitting controller 121 performs optical writing on the photoconductor drum 109 by making the LEDA 130 emit at predetermined line period.

The line period that the light emitting controller 121 controls the LEDA 130 is determined by output resolution of the image forming apparatus 1. In case of enlarging/reducing in the sub-scanning direction in accordance with a ratio to conveyance velocity of paper as described above, the light emitting controller 121 performs enlarging/reducing in the sub-scanning direction by adjusting the line period.

In addition, the light emitting controller 121 drives the LEDA 130 based on drawing information input from the engine controller 31, and the light emitting controller 121 controls the LEDA 130 to draw patterns for correcting in correcting the drawing parameters as described above.

As described above with reference to FIG. 4, the multiple LEDAs 130 correspond to each color. Therefore, as shown in FIG. 5, the multiple light emitting controllers 121 correspond to each of the multiple LEDAs 130. A correction value generated as a result of alignment correction among processes of correcting the drawing parameters is stored in the correction value storage unit 125 shown in FIG. 5 as the displacement correction value. Based on the displacement correction value stored in the correction value storage unit 126, the light emitting controller 121 corrects timing of driving the LEDA 130.

More specifically, in correcting the timing of driving the LEDA 130 by the emitting controller 121, the timing of driving the LEDA 130 is delayed in units of line periods based on the drawing information input from the engine controller 31. That is, it is implemented by shifting the lines. By contrast, the drawing information is input from the engine controller 31 sequentially in accordance with the predetermined period. Therefore, in order to delay the timing of emitting by shifting the lines, it is necessary to store the input drawing information and delay timing of reading the input drawing information.

To cope with the issue described above, the light emitting controller 121 includes a line memory as a storage device to store the drawing information input for each main scanning line, and the light emitting controller 121 stores the drawing information input from the engine controller 31 in the line memory. In addition to the adjustment in units of line periods, the timing of driving the LEDA 130 is corrected by fine adjusting timing of emitting for each line period.

The counter 122 starts counting when the light emitting controller 121 starts illuminating the photoconductor drum 109K by controlling the LEDA 130 in the process of alignment correction described above. The counter 122 acquires the detection signal that the sensor controller 123 outputs by detecting the patterns for alignment correction based on the output signal from the pattern detection sensor 117. In addition, the counter 122 inputs a count value at a timing of acquiring the detection signal into the correction value calculator 124. That is, the counter 122 functions as a detection timing acquisition unit that acquires the timing of detecting the patterns.

The sensor controller 123 controls the pattern detection sensor 117. As described above, the sensor controller 123 outputs the detection signal when it is determined that the patterns for alignment correction formed on the conveyance belt 105 reach at the position where the pattern detection sensor 117 is located based on the output signal from the pattern detection sensor 117. That is, the sensor controller 123 functions as a detection signal acquisition unit that acquires the detection signal for the patterns from the pattern detection sensor 117.

In correcting density using the patterns for correcting density, the sensor controller 13 acquires signal strength of the output signal from the pattern detection sensor 117 and inputs it into the correction value calculator 124. Furthermore, the sensor controller 123 adjusts timing of detecting the patterns for correcting density in accordance with the result of detecting the patterns for alignment correction.

Based on the count value acquired from the counter 122 and the signal strength of the result of detecting the patterns for correcting density acquired from the sensor controller 123, the correction value calculator 124 calculates the correction value based on the reference values for alignment correction and density stored in the reference value storage unit 125. That is, the correction value calculator 124 functions as a reference value acquisition unit and a correction value calculator. The reference value storage unit 125 stores the reference values used for calculating described above.

Figure 6:
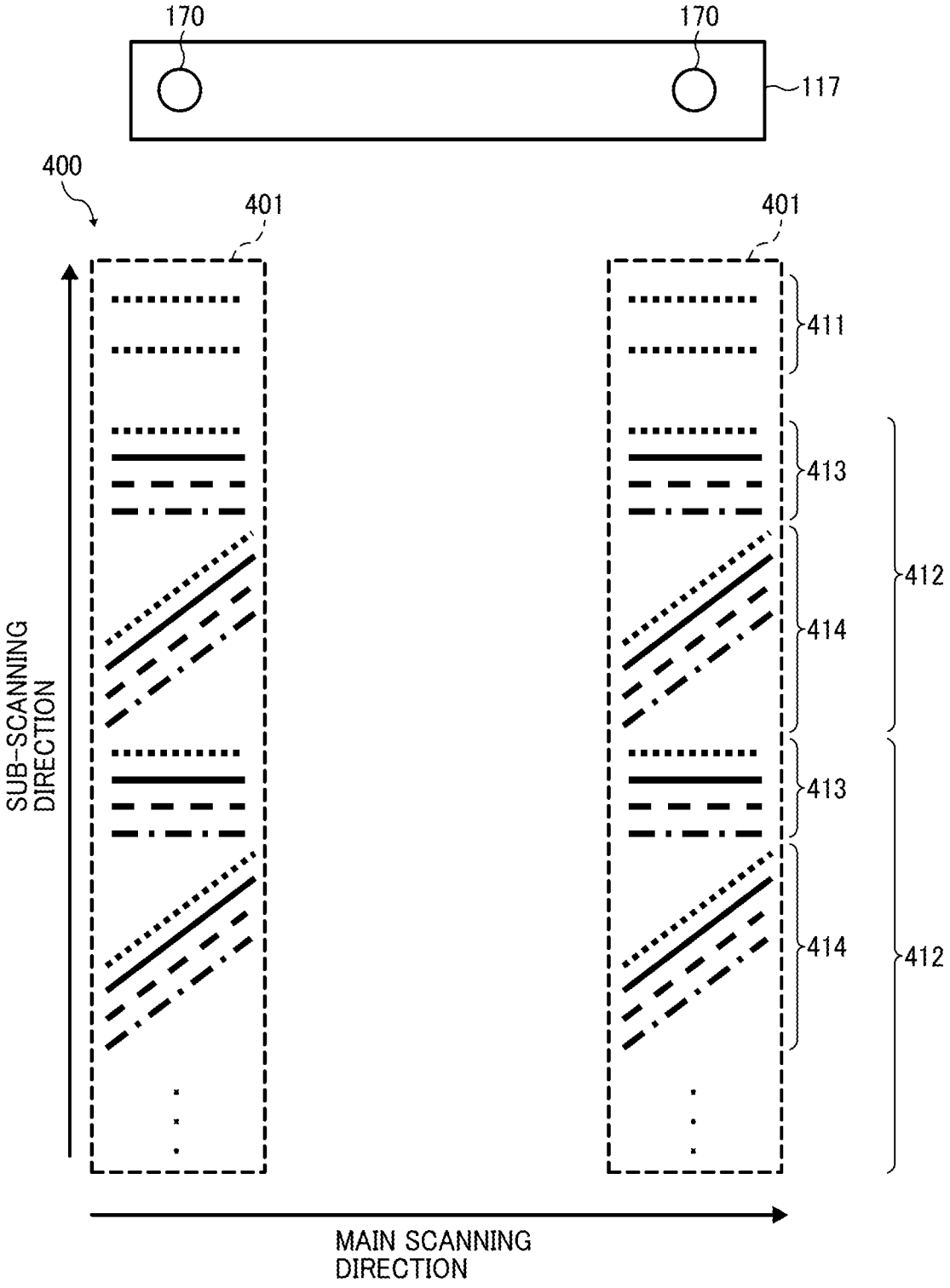
FIG. 6 is a diagram illustrating conventional patterns for correcting.

How to correct displacement using the patterns for alignment correction is described below. First, as assumption of alignment correction in this embodiment, how to correct displacement conventionally is described below. FIG. 6 is a diagram illustrating conventional marks for alignment correction drawn on the conveyance belt 105 by the LEDA 130 controlled by the light emitting controller 121 (hereinafter referred to as "marks for alignment correction").

As shown in FIG. 6, conventional marks for alignment correction 400 is configured by laying out multiple pattern columns for alignment correction 401 (two in this embodiment) that various patterns are laid out in the sub-scanning direction in the main scanning direction. In FIG. 6, solid lines indicate patterns drawn by the photoconductor drum 109K, dashed lines indicate patterns drawn by the photoconductor drum 109Y, broken lines indicate patterns drawn by the photoconductor drum 109C, and chain lines indicate patterns drawn by the photoconductor drum 109M.

As shown in FIG. 6, the pattern detection sensor 117 includes multiple sensor devices 170 (two in this embodiment) in the main scanning direction, and each pattern column for alignment correction 401 is drawn at a position corresponding to each sensor device 170. As a result, the optical writing unit controller 120 can detect patterns at multiple positions in the main scanning direction, and it is possible to correct skew of drawn images. In addition, it is possible to improve correction accuracy by averaging the results detected by the multiple sensor devices 170.

As shown in FIG. 6, the pattern column 401 includes patterns for correcting aggregative positions 411 and patterns for correcting intervals between drums 412. As shown in FIG. 6, the patterns for correcting intervals between drums 412 are drawn repeatedly.

As shown in FIG. 6, the patterns for correcting aggregative positions 411 is drawn by the photoconductor drum 109Y and in parallel with the main scanning direction. The patterns for correcting aggregative positions 411 is drawn to acquire a count value for alignment correction of aggregative image in the sub-scanning direction, i.e., transferred position of an image on the paper. In addition the patterns for correcting aggregative positions 411 is used for correcting timing of detecting the patterns for correcting intervals between drums 412 and patterns for correcting density (described later) by the sensor controller 123.

In correcting the aggregative positions using the patterns for correcting aggregative positions 411, the optical writing unit controller 120 corrects timing of starting writing based on a signal of scanning the patterns for correcting aggregative positions 411 from the pattern detection sensor 117.

The patterns for correcting intervals between drums 412 is a pattern drawn to acquire a count value for correcting shift of timing of drawing at each photoconductor drum 109, i.e., superimposed positions where images for each color are superimposed. As shown in FIG. 6, the patterns for correcting intervals between drums 412 include patterns for correcting in the sub-scanning direction 413 and patterns for correcting in the main scanning direction 414. As shown in FIG. 6, the patterns for correcting intervals between drums 412 consist of the repeated patterns for correcting in the sub-scanning direction 413 and the patterns for correcting in the main scanning direction 414 combining patterns for each of colors, C, M, Y, and K as one set.

The optical writing unit controller 120 corrects displacement in the sub-scanning direction for each of the photoconductor drums 109K, 109M 1090, and 109Y based on the scanned signal of the patterns for correcting in the sub-scanning direction 413 from the pattern detection sensor 117. In addition, the optical writing unit controller 120 corrects displacement in the main scanning direction for each of the photoconductor drums 109K, 109M, 109C, and 109Y based on the scanned signal of the patterns for correcting in the main scanning direction 414.

The patterns for correcting in the sub-scanning direction 413 are horizontal in parallel with the main scanning direction. As shown in FIG. 6, by drawing the patterns for correcting intervals between drums 412 in the sub-scanning direction repeatedly, the multiple patterns for correcting in the main scanning direction 414 are included in the mark for alignment correction in different positions in the sub-scanning direction.

Figure 7:
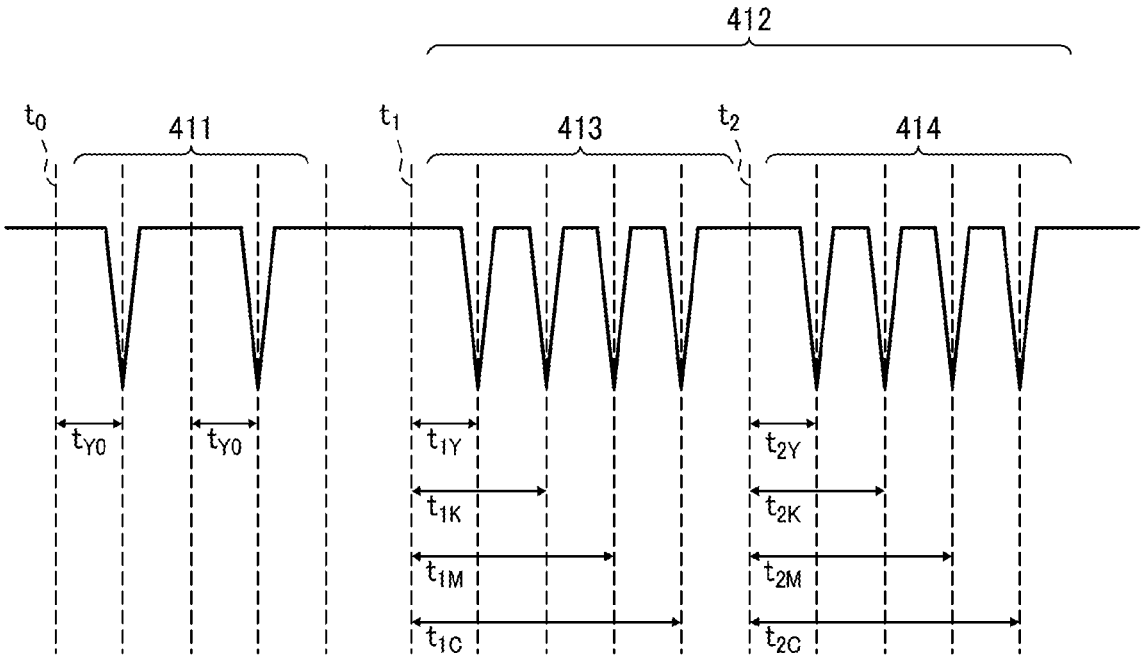
FIG. 7 is a chart illustrating timing of detecting patterns for alignment correction as an embodiment of the present invention.

The reference values for timing for each color stored in the reference value storage unit 125 are described below with reference to FIG. 7. FIG. 7 is a chart illustrating timing of detecting the patterns for correcting aggregative positions 411 and the patterns for correcting intervals between drums 412. As shown in FIG. 7, detection period $t_{Y0}$ of the patterns for correcting aggregative positions 411 is a detection period from detection start timing to just before lines drawn by the photoconductor drum 109Y are scanned.

Detection periods $t_{1Y}$, $t_{1K}$, $t_{1M}$, $t_{1C}$ for the patterns for correcting in the sub-scanning direction 413 and detection periods $t_{2Y}$, $t_{2K}$, $t_{2M}$, $t_{2C}$ for the patterns for correcting in the main scanning direction 414 included in the patterns for correcting intervals between drums 412 are detection periods from detection start timing $t_1$ and $t_2$ just before the set of patterns are scanned.

The reference value storage unit 125 stores a reference value for the detection period to for the pattern for correcting aggregative positions 411 and reference values for the detection periods $t_{1y}$, $t_{1K}$, $t_{1M}$, $t_{1C}$, $t_{2Y}$, $t_{2K}$, $t_{2M}$, and $t_{2C}$ for the patterns for correcting in the sub-scanning direction 413 and the patterns for correcting in the main scanning direction 414 shown in FIG. 7. In other words, the reference value storage unit 125 stores a theoretical value for the detection period $t_{y0}$ for the pattern for correcting aggregative positions 411 and theoretical values for the detection period $t_{y0}$, $t_y$, $t_k$, $t_m$, and $t_c$ for the patterns for correcting in the sub-scanning direction 413 and the patterns for correcting in the main scanning direction 414 in case of constructing detailed configurations of all units included in the image forming apparatus as they are designed as the reference values.

That is, the correction value calculator 124 calculates difference values from design values of the image forming apparatus that includes the correction value calculator 124 by calculating difference values between the reference values stored in the reference value storage unit 125 and the detection periods $t_{y0}$, $t_y$, $t_k$, $t_m$, and $t_c$. Subsequently, the correction value calculator 124 calculates correction values for correcting emitting timings of the LEDA 130.

The reference value for the detection period to for the pattern for correcting aggregative positions 411 can be used for correcting timings for starting detecting $t_1$ and $t_2$ shown in FIG. 7. That is, the correction value calculator 124 calculates correction values for correcting the timings for starting detecting $t_1$ and $t_2$ shown in FIG. 7 based on the difference between the detection period $t_{y0}$ for the pattern for correcting aggregative positions 411 and its reference value. Consequently, it is possible to improve precision of detection periods in the patterns for correcting intervals between drums 412.

Figure 8:
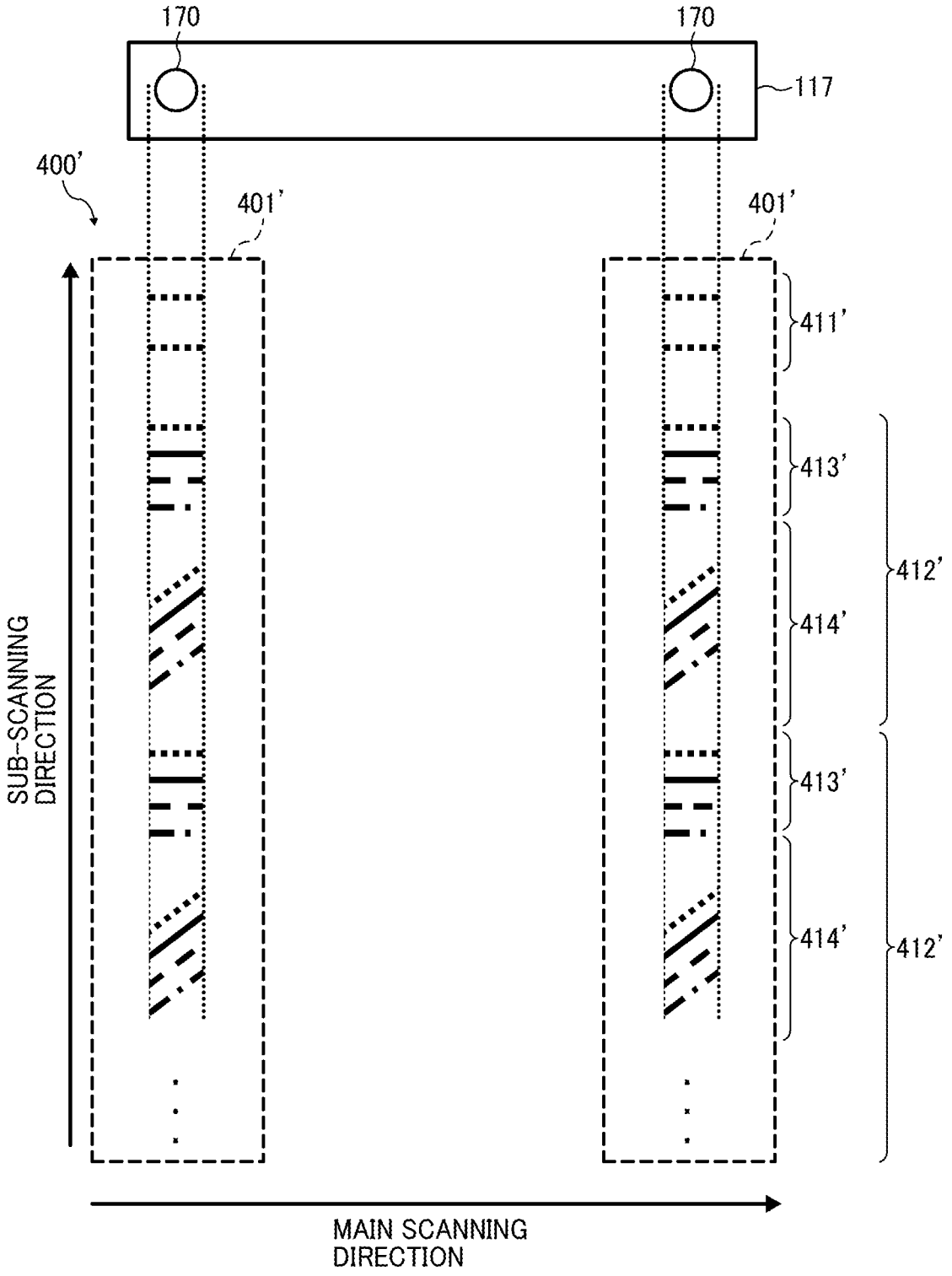
FIG. 8 is a diagram illustrating patterns correcting width in accordance with detection areas for sensor devices as an embodiment of the present invention.

Since the marks for alignment correction 400 are drawn every time in alignment correction repeatedly performed at the predetermined timing, it is necessary to minimize the drawing area to reduce toner consumption. Therefore, as shown in FIG. 8, it is ideal to adjust width of each pattern in the main scanning direction in accordance with the detection area of the sensor device 170. In FIG. 8, signs for patterns that correspond to patterns shown in FIG. 6 are apostrophized.

While a detection area 170' of the sensor device 170 shown in FIG. 8 is determined theoretically depending on performance of the sensor device 170 and its installation status, the detection area 170' can vary depending on status change, idiosyncrasy, and error in installation status of the sensor device 170. Therefore, even in case of adjusting the widths of the patterns in the main scanning direction included in the marks for alignment correction 400' to the size of the detection area 170' determined theoretically, that cannot be the most appropriate size as shown in FIG. 8. In this embodiment, depending on the fluctuation of the detection area 170' described above, the widths of the patterns in the main scanning direction included in the marks for alignment correction 400' can be adjusted optimally.

Figure 9:
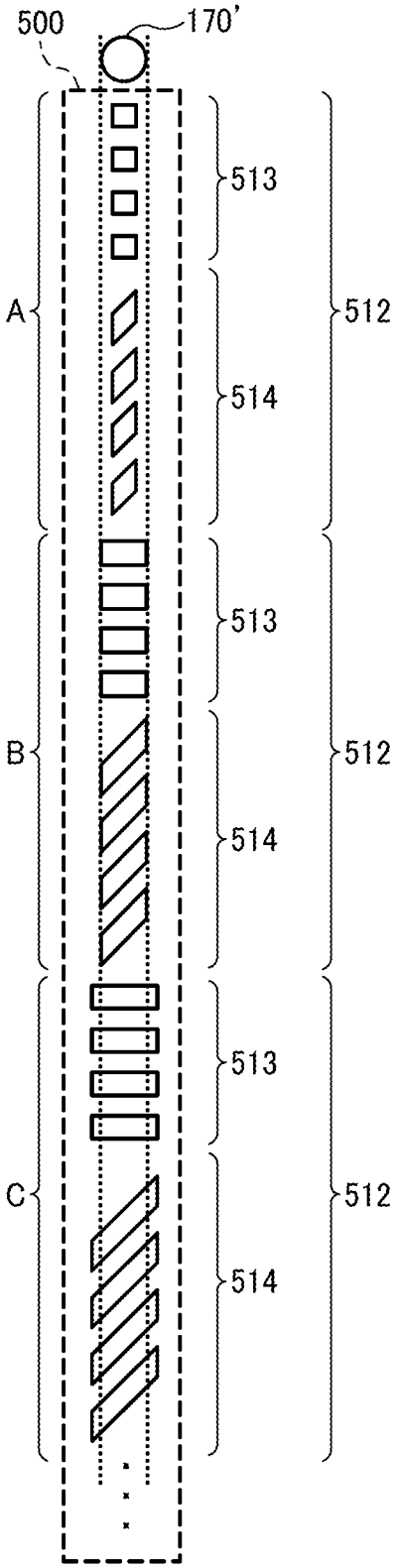
FIG. 9 is a diagram illustrating patterns for recognizing the detection area as an embodiment of the present invention.

FIG. 9 is a diagram illustrating patterns 500 drawn for configuring the widths of the patterns in the main scanning direction included in the marks for alignment correction 400' depending on the fluctuation of the detection area 170' optimally (hereinafter referred to as "patterns for recognizing the detection area"). As shown in FIG. 9, in the patterns for recognizing the detection area 500, similar to the marks for alignment correction 400, a set of patterns 512 is drawn in the sub-scanning direction repeatedly just like the patterns for correcting intervals between drums 412.

The set of patterns 512 includes a horizontal pattern 513 similar to the patterns for correcting in the sub-scanning direction 413 and a diagonal pattern 514 similar to the patterns for correcting in the main scanning direction 414 just like the patterns for correcting intervals between drums 412. Each set of pattern 512 includes four patterns for each of colors, C, M, Y, and K in total just like the patterns for correcting intervals between drums 412.

As shown in FIG. 9, in the set of patterns 512 drawn repeatedly in the sub-scanning direction, the widths in the main scanning direction vary gradually with each repetition, and the widths increase gradually in this embodiment. As described above, in this embodiment, in each set of patterns 512, the widths in the main scanning direction increase gradually.

In FIG. 9, the width in the main scanning direction in pattern A is narrower than the width in the main scanning direction of the detection area 170', the width in the main scanning direction in pattern B is almost the same as the detection area 170', and the width in the main scanning direction in pattern C is narrower than the width in the main scanning direction of the detection area 170'. While only three patterns A, B, and C are shown in FIG. 9, it is possible to draw the widths in the main scanning direction of the set of patterns 512 so that they increase gradually for each repeated pattern.

Figure 10:
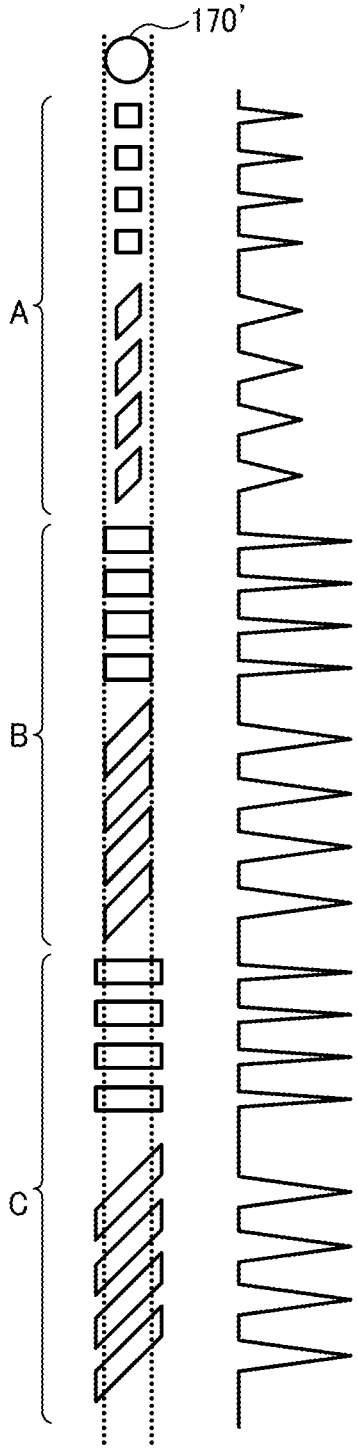
FIG. 10 is a diagram illustrating a detection signal of the patterns for recognizing the detection area as an embodiment of the present invention.

FIG. 10 is a diagram illustrating a detection signal output by the sensor device 170 in case the set of patterns 512 that includes A, B, and C is drawn as shown in FIG. 9 and the width of the detection area 170' is almost the same as the width in the main scanning direction of the set of patterns 512 as B. As shown in FIG. 10, since the width in the main scanning direction of the set of patterns 512 as A is narrower than the width in the main scanning direction of the detection area 170', peak level of the detection signal does not get up to the maximum value.

By contrast, since the width in the main scanning direction of the set of patterns 512 as B is almost the same as the width in the main scanning direction of the detection area 170', the peak level of the detection signal reaches the maximum value. Lastly, since the width in the main scanning direction of the set of patterns 512 as C is wider than the width in the main scanning direction of the detection area 170' and the areas that run off the detection area 170' do not affect to the detection signal, the peak level of the detection signal for the set of patterns 512 as C is the same as the peak level of the detection signal for the set of patterns 512 as B.

In the case shown in FIG. 10, the width of pattern B is the most appropriate as the width in the main scanning direction for each pattern included in the marks for alignment correction 400' since the peak level of the detection signal reaches the maximum value and there is no waste of toner. In the case of the width of pattern A, since its width in the main scanning direction is narrower than the width in the main scanning direction of the detection area 170', the peak level of the detection signal does not get up to the maximum value, and that can cause an error in detecting patterns.

In the case of the width of pattern C, since its width is wider enough than the width in the main scanning direction of the detection area 170', the peak level of the detection signal reaches the maximum value. However, the pattern runs off the detection area 170', and that results in consuming extra toner.

Figure 11:
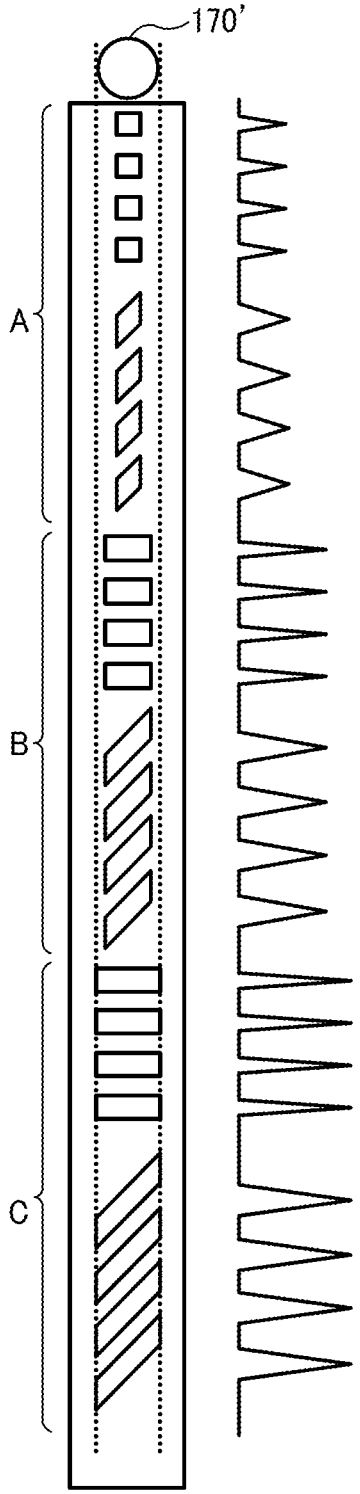
FIG. 11 is a diagram illustrating another detection signal of the patterns for recognizing the detection area as an embodiment of the present invention.

FIG. 11 is a diagram illustrating a detection signal output by the sensor device 170 in case the set of patterns 512 that includes A, B, and C is drawn as shown in FIG. 9 and the width of the detection area 170' is almost the same as the width in the main scanning direction of the set of patterns 512 as C. As shown in FIG. 11, since the width in the main scanning direction of the set of patterns 512 as A is narrower than the width in the main scanning direction of the detection area 170', peak level of the detection signal does not get up to the maximum value.

In the case shown in FIG. 11, the width of the detection area 170' is furthermore wider than the case shown in FIG. 10. Therefore, the size of set of patterns 512 as A compared to the detection area 170' is relatively narrower than the case shown in FIG. 10 in case the sensor device 170 detects the size of set of patterns 512 as A. Consequently, the peak level of the detection signal in case the sensor device 170 detects the set of patterns 512 as A becomes further lower than the case shown in FIG. 10.

Since the width in the main scanning direction of the set of patterns 512 as B is narrower than the width in the main scanning direction of the detection area 170', the peak level of the detection signal does not get up to the maximum value. Lastly, since the width in the main scanning direction of the set of patterns 512 as C is almost the same as the width in the main scanning direction of the detection area 170', the peak level of the detection signal reaches the maximum value.

In the case shown in FIG. 11, the width of pattern C is the most appropriate as the width in the main scanning direction for each pattern included in the marks for alignment correction 400'. By contrast, in the case of the widths of pattern A and pattern B, since their width in the main scanning direction are narrower than the width in the main scanning direction of the detection area 170', the peak levels of the detection signal do not get up to the maximum value, and that can cause an error in detecting patterns.

Figure 12:
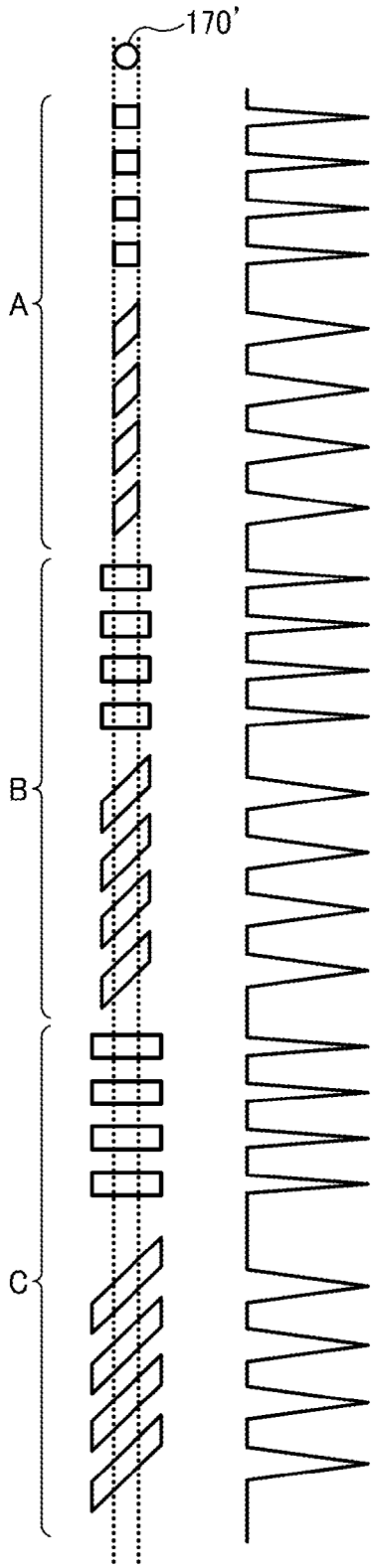
FIG. 12 is a diagram illustrating yet another detection signal of the patterns for recognizing the detection area as an embodiment of the present invention.

FIG. 12 is a diagram illustrating yet another detection signal output by the sensor device 170 in case the set of patterns 512 that includes A, B, and C is drawn as shown in FIG. 9 and the width of the detection area 170' is almost the same as the width in the main scanning direction of the set of patterns 512 as C. As shown in FIG. 12, since the width in the main scanning direction of the set of patterns 512 as A is almost the same as the width in the main scanning direction of the detection area 170', the peak level of the detection signal reaches the maximum value.

By contrast, since the widths in the main scanning direction of the sets of patterns 512 as B and C are wider than the width in the main scanning direction of the detection area 170' and the areas that run off the detection area 170' do not affect to the detection signal, the peak levels of the detection signal for the sets of patterns 512 as B and C is the same as the peak level of the detection signal for the set of patterns 512 as A.

In the case shown in FIG. 12, the width of pattern A is the most appropriate as the width in the main scanning direction for each pattern included in the marks for alignment correction 400' since the peak level of the detection signal p to the maximum value and there is no waste of toner.

In the case of the width of pattern B and C, since their widths are wider enough than the width in the main scanning direction of the detection area 170', the peak levels of the detection signal get up to the maximum value. However, the patterns run off the detection area 170', and that results in consuming extra toner.

As described above, in the optical writing unit controller 120 in this embodiment, in order to determine the width in the main scanning direction the set of patterns 512 is drawn repeatedly in the sub-scanning direction so that the width in the main scanning direction increases gradually for each set of patterns as shown in FIG. 9. Subsequently, by referring to the peak levels of the detection signal corresponding to the sets of patterns 512, the width of the pattern at the time of saturating the fluctuation of the peak levels in accordance with the width in the main scanning direction is determined as the width in the main scanning direction for the patterns included in the marks for alignment correction 400'.

Next, configuration of width of the pattern based on the patterns for recognizing the detection area 500 is described below with reference to a flowchart shown in FIG. 13. As described above, in configuring the width of the pattern in accordance with the width in the main scanning direction of the detection area 170' based on the patterns for recognizing the detection area 500, first, the optical writing unit controller 120 corrects displacement in S1301.

As described above with reference to FIG. 6, it is preferable to perform alignment correction in S1301 by drawing the marks for alignment correction 400 includes the patterns that have enough margin compared to the width in the main scanning direction of the detection area 170'. Subsequently, it is started to configure the width of the patterns based on the patterns for recognizing the detection area 500, and the light emitting controller 121 starts drawing the patterns for recognizing the detection area 500 in S1302.

In response to starting drawing the patterns for recognizing the detection area 500 by the light emitting controller 121, the sensor controller 123 starts detecting the patterns using the detection signal output by the pattern detection sensor 117 in S1303. As a result, the correction value calculator 124 acquires information on the result of detecting that indicates values in accordance with the peak level of the detection signal as described above with reference to FIGS. 10, 11, and 12.

After starting acquiring the information on the result of detecting, the correction value calculator 124 refers to the peak level for each of the set of the patterns 512 in S1304. In S1304, the correction value calculator 124 refers to an average value of the peak levels for each of the set of the patterns 512. However, that is an example, and other characteristic values such as a median value, a minimum value, and a maximum value can be used as the peak levels for each of the set of the patterns 512.

The correction value calculator 124 sequentially refers to the peak level for each of the set of the patterns acquired in series and determines the saturation of the peak levels by comparing with the peak level of the set of the patterns 512 referred previously in S1305. In S1305, difference value between two peak levels to be compared is calculated, and it is determined that the peak level is saturated if the difference value is less than a predetermined threshold value.

In S1305, it is determined whether or not the peak level reaches the maximum value as described above with reference to FIGS. 10, 11, and 12. In the case shown in FIG. 10, it is determined that the peak level is saturated in comparing the peak level of the set of the patterns as B with the peak level of the set of the patterns as C.

In the case shown in FIG. 11, it is determined that the peak level is saturated in comparing the peak level of the set of the patterns as C with next set of the patterns whose width in the main scanning direction is further wider than the set of the patterns as C. In the case shown in FIG. 12, it is determined that the peak level is saturated in comparing the peak level of the set of the patterns as A with the peak level of the set of the patterns as B.

After the step in S1305, if the peak level is not saturated (NO in S1305), i.e., the calculated difference value is greater than the predetermined threshold value, the correction value calculator 124 repeats the steps from S1304 on the result of detecting acquired newly. By contrast, if the peak level is saturated (YES in S1305), i.e., the calculated difference value is less than the predetermined threshold value, the correction value calculator 124 configures the width in the main scanning direction of the pattern whose width in the main scanning direction is narrower between the two sets of the patterns whose peak levels are compared as the most appropriate width of the patterns in accordance with the width in main scanning direction of the detection area 170' in S1307. Subsequently, the process ends. As described above, it is finished to configure the width of the patterns in this embodiment.

As described above, after finishing alignment correction using the marks for alignment correction 400 shown in FIG. 6 and configuring the width of the patterns in accordance with the width in the main scanning direction of the detection area 170', in drawing the marks for alignment correction 400' that consist of the patterns whose width is adjusted in accordance with the width in the main scanning direction of the detection area 170', center in the main scanning direction of the patterns are aligned with center in the main scanning direction of the detection area 170', and the patterns are drawn so that the width in the main scanning direction of the patterns is adjusted in accordance with the width in the main scanning direction of the detection area 170'. As a result, it is preferably performed to correct displacement using the marks for alignment correction 400'.

As described above, in the optical writing unit 111 in this embodiment, the width in the main scanning direction of the detection area 170' is determined by the width in the main scanning direction of the patterns when the peak level of the detection signal for the set of the patterns 512 drawn repeatedly whose width in the main scanning direction increases gradually with repetition is saturated. Consequently, it is possible that the size of the patterns for correcting positions where images are drawn in the image forming apparatus corresponds to the fluctuation in the detection area of the sensor that detects the patterns for correcting.

In the embodiment described above with reference to FIG. 9, the set of patterns 512 consists of the horizontal pattern 513 and the diagonal pattern 514. However, that is an example, and the set of patterns 512 can use the same pattern as the marks for alignment correction 400 including the patterns for correcting aggregative positions 411 described above with reference to FIG. 6.

In this case, in drawing the patterns for correcting intervals between drums 412 drawn repeatedly, in case of drawing them so that the width in the main scanning direction increases gradually for each repetition, it is possible to adopt the same configuration as in the case of the set of patterns 512 described above and to bring about the same effect. Consequently, if the width in the main scanning direction of the patterns for correcting intervals between drums 412 drawn repeatedly is configurable by setting parameters, it is possible to use the same information as the marks for alignment correction 400 as the information for drawing the patterns. Therefore, it is unnecessary to prepare the information for drawing the patterns for recognizing the detection area 500 separately, and that can reduce the necessary storage size.

In the embodiment described above, the set of patterns 512 that consists of the patterns for recognizing the detection area 500 includes the horizontal pattern 513 and the diagonal pattern 514. However, in configuring the width of the patterns in accordance with the width in the main scanning direction of the detection area 170', the peak level for each of the sets of patterns is necessary as described above with reference to FIG. 13. Therefore, as shown in FIG. 14, even if the set of patterns 512 consists of the horizontal patterns only, it is possible to bring about the same effect.

In the embodiment described above, the set of patterns 512 includes the patterns for colors C, M, Y, and K. Consequently, it is possible to take the results of detecting each color into consideration and configure the width of the patterns more precisely. However, in this embodiment, it is important to recognize the width in the main scanning direction of the detection area 170', and fluctuation for each color is not needed for that purpose. Therefore, it is possible to draw the horizontal pattern for any one of colors C, M, Y, and K repeatedly so that the width in the main scanning direction of those patterns increases gradually for each repetition.

In this case, it is possible to draw more than three patterns for correcting aggregative positions 411 described above with reference to FIG. 6 repeatedly instead of two patterns for correcting aggregative positions 411 as shown in FIG. 6 so that the width in the main scanning direction increases gradually for each repetition. Consequently, it is possible to include various functions in the patterns shown in FIG. 6, and it is unnecessary to store information on various patterns in the optical writing unit controller 120.

Figure 13:
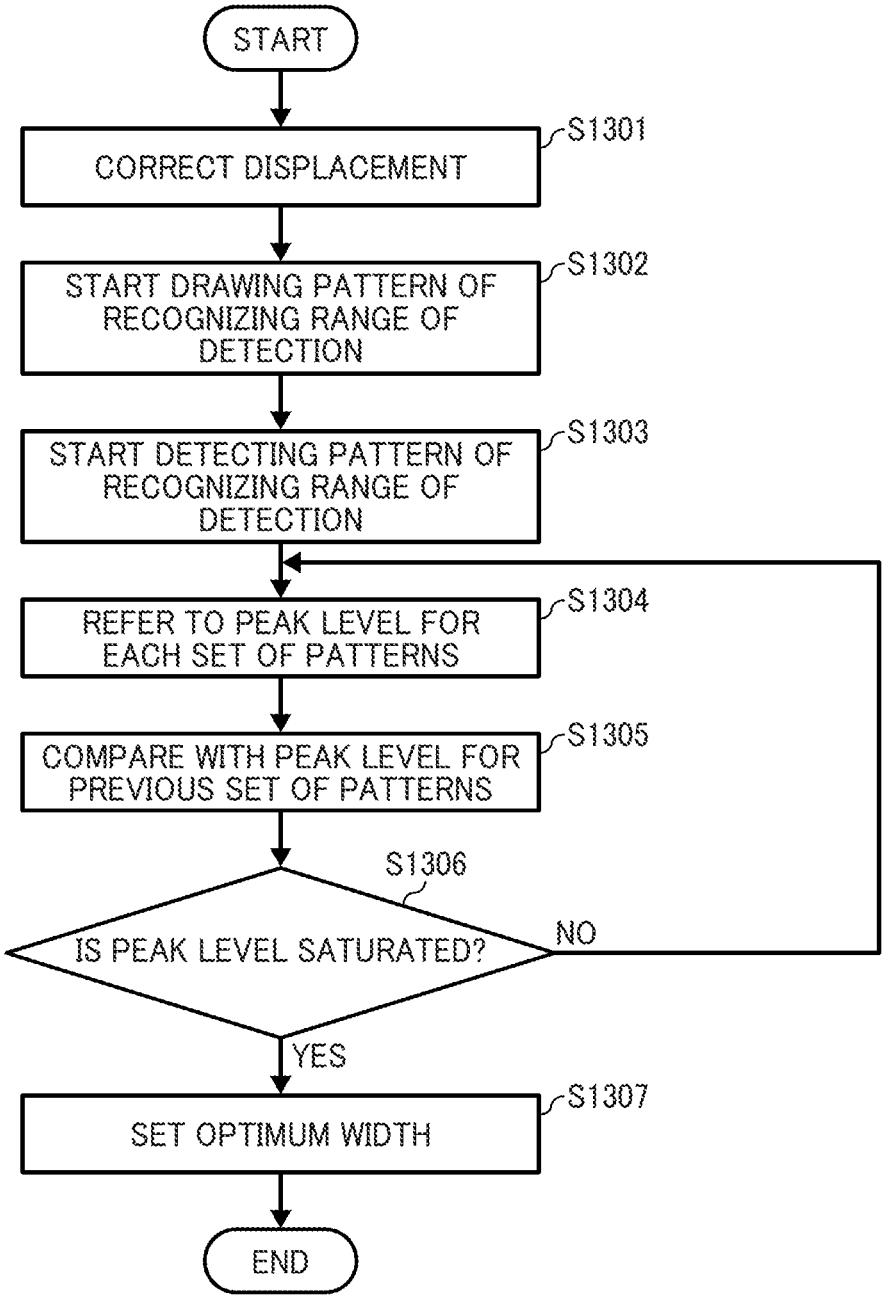
FIG. 13 is a flowchart illustrating a process of configuring a pattern width as an embodiment of the present invention.
Figure 14:
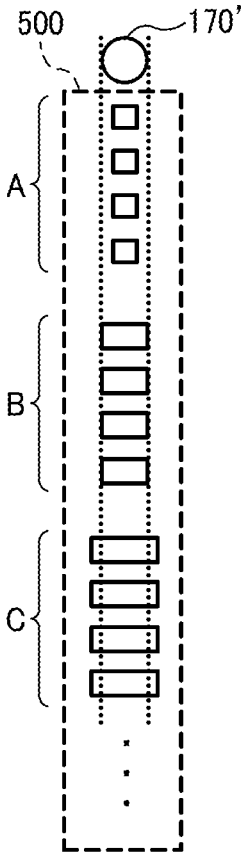
FIG. 14 is a diagram illustrating patterns for recognizing the detection area as an embodiment of the present invention.

In the embodiment described above with reference to the steps S1305 and S1306 in FIG. 13, the width in the main scanning direction of the patterns at the time when the peak level is saturated is configured as the most appropriate width of the patterns. However, in detecting patterns precisely, the saturation of the peak level is not always necessary and it is needed that the peak level is detectable appropriately.

Therefore, instead of determining the saturation of the peak level, after comparing a threshold value for determining that the peak level is detectable appropriately with the peak level referred in S1304, if the peak level exceeds the threshold value it is possible to configure the width in the main scanning direction of the set of patterns that corresponds to the peak level as the most appropriate width of patterns.

In this case, the signal strength of the detection signal of the sensor device 117 can differ for each color C, M, Y, and K even if the widths of patterns are the same. For example, in the case of the patterns shown in FIG. 9, while the width of pattern A is enough for the dark pattern K, the width of pattern B is necessary for the pale pattern Y in some cases.

Therefore, in case of determining the most appropriate width of patterns by comparing the predetermined threshold value with the peak level instead of the saturation of the peak level, as described above with reference to S1304 in FIG. 13, instead of using the averaged value or chosen value for each set of patterns 512, it is preferable to determine the peak level with the threshold value for each color and configure the most appropriate width of patterns for each color. Consequently, the pattern in dark colors such as K is drawn using narrower patterns with avoiding an error in detecting pattern, and it is possible to reduce the toner consumption more effectively.

In view of optimizing apparatus control, the configuration of the width of patterns should not to be performed too often, and it is preferable to perform that at appropriate timings. FIG. 15 is a table illustrating timings to perform configuring the width of patterns, criteria for detecting the timing, and reasons to adopt the timing.

As shown in FIG. 15, in the case of "when assembly state is changed", assembly state of each unit that comprises the image forming apparatus 1 is changed, and as a result, the detection area 170' can be varied. Therefore, the widths of the patterns are configured. Causes to determine "when assembly state is changed" are detecting that the photoconductor unit that consists of the photoconductor drum 109 is replaced, detecting that the intermediate transferring unit that consists of the conveyer belt 105 is replaced, and detecting other environmental variation. These detections are implemented by the CPU 10 that controls the whole part of the image forming apparatus included in the print engine 26.

In the case of "when malfunction occurs", since it is not appropriately performed that the pattern detection sensor 117 illuminates the pattern detection sensor 117 with light and receives the reflected light, the width of the patterns is configured. Causes to determine "when malfunction occurs" are detecting failing to adjust light amount by the pattern detection sensor 117, detecting failing to correct displacement using the marks for alignment correction 400' shown in FIG. 8, and detecting failing to adjust density using the pattern for adjusting density. These detections are implemented by the subject that performs each correction, i.e., by the correction value calculator 124 described above with reference to FIG. 5.

In the case of "on regular basis", since the assembly state of each unit in the main body and the state of the pattern detection sensor 117 deteriorates due to aging and it is possible that the width of the pattern is not the most appropriate, the width of the pattern is configured. Causes to determine "on regular basis" are that a count value of printed pages reaches a threshold value and a period passed since last time when the width of the pattern is configured reaches a predetermined threshold value. In this case, the main controller 30 described above with reference to FIG. 2 performs counting the number of printed paper, and the correction value calculator 124 described above with reference to FIG. 5 performs measuring the period passed since last time when the width of the pattern is configured.

The embodiments described above can be implemented by storing information that corresponds to the table described above with reference to FIG. 15 in a storage device included in the optical writing unit controller 120 and determining whether or not the width of the pattern is configured based on each of the detected causes.

In the embodiment described above, in configuring the optimal width of the pattern shown in FIG. 13, the width in the main scanning direction increases gradually as the set of patterns is drawn repeatedly as shown in FIG. 9. However, it is possible to use the patterns for correcting intervals between drums 412 included in the marks for alignment correction 400 shown in FIG. 6 as the pattern whose width in the main scanning direction increases gradually for each repetition and use such pattern for correcting each time.

In this case, the toner consumption can be less reduced compared to the case that the width in the main scanning direction of each pattern equals to the width in the main scanning direction of the detection area 170' as described above with reference to FIG. 8. However, it is possible to reduce the toner consumption compared to the case that draws the pattern shown in FIG. 6. Furthermore, since the width in the main scanning direction of the pattern increases gradually, a margin to the width in the main scanning direction of the detection area 170' becomes larger gradually for each pattern drawn repeatedly even if the position of drawn patterns in the main scanning direction is misaligned.

As a result, at the time when the margin amount exceeds the displacement amount in the main scanning direction, the pattern is detected preferably. Consequently, it is possible to avoid finishing alignment correction with error and keep balance between the toner consumption and success rate in alignment correction.

It is possible to correct displacement using the marks for alignment correction 400' whose pattern width is in accordance with the width in the main scanning direction of the detection area 170' as shown in FIG. 8 normally, and it is possible to correct displacement using the marks for alignment correction 400 whose width in the main scanning direction increases for each repetition for the patterns for correcting intervals between drums 412 as shown in FIG. 9 when the various causes described above with reference to FIG. 15 are detected. Consequently, even in an emergency, it is possible to reconfigure the pattern width with finishing alignment correction.

In the embodiment described above, as shown in FIG. 9, the width in the main scanning direction of the set of patterns 512 increases gradually with repetition. However, this is an example, and it is possible to make the width of the pattern become narrower gradually from the wide pattern shown in FIG. 6.

In the case of the pattern that becomes narrower gradually, the peak level of the detection signal is saturated when it starts to detect the patterns. As the width in the main scanning direction of the patterns becomes narrower, the peak level becomes lower from the detection signal for the pattern whose width in the main scanning direction is narrower than the width in the main scanning direction of the detection area 170'. Therefore, it is possible to determine the width in the main scanning direction of the detection area 170' based on the pattern wider a notch than the pattern that the peak level starts going down.

The patterns can be detected by recording a detecting result each time the detection signal exceeds a threshold value set to the detection signal for detecting the patterns without setting a predetermined detection period. In this case, it is impossible to determine which pattern is detected, and the subsequent process is performed assuming that the pattern is detected sequentially. That is, if the pattern is not detected sequentially, it is impossible to perform the subsequent process appropriately.

By contrast, in the case of the wide patterns shown in FIG. 6, since the possibility of failing to detect the patterns is low, it is possible to record the detecting result each time the pattern is detected easily as described above.

In the above description, the LEDA 130 laying out the LED devices 131 in the main scanning direction is used as the linear light source. However, the embodiments described above are in common with controlling the linear light source, and the light source is not limited to the LED devices. Alternatively, organic Electro-Luminescence (EL) devices and Laser Diode (LD) devices can be used.

The present invention also encompasses a non-transitory recording medium storing a program that executes a method of controlling a light source to expose a photoconductor and forming a latent image on the photoconductor. The method of controlling a light source includes the steps of controlling the multiple light sources corresponding to different colors based on pixel information that comprises an image to be output and to expose the multiple photoconductors corresponding to different colors, acquiring a detection signal output by a sensor that detects the image on a conveying path where a developed image of the electrostatic latent image formed on the photoconductor is transferred and conveyed, calculating a correction value for correcting a superimposing position where the developed images for different colors developing each of the electrostatic latent images formed on each of the multiple photoconductors are superimposed based on the detection signal output by the sensor that detects a pattern for correcting the superimposing position, controlling the multiple light sources to draw a predetermined pattern repeatedly in the sub-scanning direction so that stepwise patterns whose width in the main scanning direction varies with repetition are formed, and determining the width in the main scanning direction of the patterns for correcting based on strength of the detection signal output by the sensor that detects the stepwise patterns.

Numerous additional modifications and variations are possible in light of the above teachings. It is therefore to be understood that, within the scope of the appended claims, the disclosure of this patent specification may be practiced otherwise than as specifically described herein.

As can be appreciated by those skilled in the computer arts, this invention may be implemented as convenient using a conventional general-purpose digital computer programmed according to the teachings of the present specification. Appropriate software coding can readily be prepared by skilled programmers based on the teachings of the present disclosure, as will be apparent to those skilled in the software arts. The present invention may also be implemented by the preparation of application-specific integrated circuits or by interconnecting an appropriate network of conventional component circuits, as will be readily apparent to those skilled in the relevant art.

What is claimed is:

1. An optical writing controller that controls multiple light sources corresponding to different colors to expose multiple photoconductors and form an electrostatic latent image on the photoconductor, comprising:

a light emitting controller to control the multiple light sources based on pixel information that comprises an image to be output and to expose the multiple photoconductors corresponding to different colors, and to control the multiple light sources to draw a predetermined pattern repeatedly in the sub-scanning direction to form stepwise patterns whose width in the main scanning direction varies with repetition;

a correction value calculator to obtain a detection signal generated based on the stepwise patterns, and to determine the width in the main scanning direction of patterns for correcting based on the strength of the detection signal generated based on the stepwise patterns, and a detection signal acquisition unit to acquire a detection signal generated based on the patterns for correcting having the determined width, wherein the correction value calculator calculates a correction value for correcting a superimposing position where developed images for different colors of each of the electrostatic latent images formed on each of the multiple photoconductors are superimposed based on the detection signal generated based on the patterns for correcting having the determined width.

2. The optical writing controller according to claim 1, wherein the light emitting controller controls the multiple light sources to form the stepwise patterns whose width in the main scanning direction increases with repetition, and the correction value calculator determines the width in the main scanning direction of the pattern for correcting based on the width in the main scanning direction of the predetermined pattern when the strength of the detection signal for each of the predetermined patterns drawn repeatedly in the stepwise patterns reaches a maximum value.

3. The optical writing controller according to claim 1, wherein the light emitting controller controls the multiple light sources to form the stepwise patterns whose width in the main scanning direction increases with repetition, and the correction value calculator determines the width in the main scanning direction of the pattern for correcting based on the width in the main scanning direction of the predetermined pattern when the strength of the detection signal for each of the predetermined patterns drawn repeatedly in the stepwise patterns exceeds a predetermined threshold value.

4. The optical writing controller according to claim 3, wherein the correction value calculator determines the widths in the main scanning direction of the patterns for correcting for each of different colors based on the strength of the detection signal of the stepwise patterns for each of the different colors.

5. The optical writing controller according to claim 1, wherein the light emitting controller forms the patterns for correcting as the stepwise patterns by controlling the multiple light sources so that the width in the main scanning direction of the pattern drawn repeatedly in the patterns for correcting varies with repetition.

6. The optical writing controller according to claim 1, wherein the patterns for correcting include a pattern for correcting aggregative positions for correcting a position where the electrostatic latent image formed on the photoconductor is developed and transferred, and the light emitting controller forms the pattern for correcting aggregative positions as the stepwise patterns by controlling the multiple light sources so that the width in the main scanning direction of the pattern drawn repeatedly in the pattern for correcting aggregative positions varies with repetition.

7. The optical writing controller according to claim 1, wherein the light emitting controller controls the multiple light sources to form the stepwise patterns with correcting the superimposing position using the correction value calculated by the correction value calculator.

8. An image forming apparatus, comprising the optical writing controller according to claim 1.

9. A method of controlling a light source to expose a photoconductor and forming an electrostatic latent image on the photoconductor, comprising the steps of:

controlling the multiple light sources based on pixel information that comprises an image to be output and exposing the multiple photoconductors corresponding to different colors, and controlling the multiple light sources to draw a predetermined pattern repeatedly in the sub-scanning direction to form stepwise patterns whose width in the main scanning direction varies with repetition;

obtaining a detection signal generated based on the stepwise patterns, and determining the width in the main scanning direction of patterns for correcting based on the strength of the detection signal generated based on the stepwise patterns;

acquiring a detection signal generated based on the patterns for correcting having the determined width; and calculating a correction value for correcting a superimposing position where developed images for different colors of each of the electrostatic latent images formed on each of the multiple photoconductors are superimposed based on the detection signal generated based on the patterns for correcting having the determined width.

* * * * *